United States Patent [19]

Patterson

[11] 4,202,144

[45] May 13, 1980

[54] CEMETERY MONUMENT

[76] Inventor: Norman B. Patterson, 4402 Phillip Ave., Billings, Mont. 59101

[21] Appl. No.: 949,959

[22] Filed: Oct. 10, 1978

[51] Int. Cl.[2] ..... E04H 13/00

[52] U.S. Cl. ..... 52/103

[58] Field of Search ..... 52/103, 104, 38; 40/124.5

[56] References Cited

U.S. PATENT DOCUMENTS

| | | | |
|---|---|---|---|
| 238,059 | 2/1881 | Schuyler | 52/103 |
| 582,470 | 5/1897 | Hammond | 52/104 |
| 623,943 | 4/1899 | Campbell | 52/103 |
| 688,043 | 12/1901 | White | 52/103 |
| 1,397,483 | 11/1921 | Brown | 52/103 |
| 2,084,521 | 6/1937 | Compton | 52/103 |
| 2,095,290 | 10/1937 | Roy | 52/38 |
| 2,525,091 | 10/1950 | Brownawell | 52/103 |
| 2,586,178 | 2/1952 | Rochester | 40/124.5 |

FOREIGN PATENT DOCUMENTS

| | | | |
|---|---|---|---|
| 425926 | 3/1935 | United Kingdom | 52/38 |

*Primary Examiner*—James L. Ridgill, Jr.
*Attorney, Agent, or Firm*—Arthur L. Urban

[57] ABSTRACT

A cemetery monument including a base and a main body section extending upwardly from the base; the body section including an outer shell formed of a plurality of textured corrosion-resistant metal panels, the edges of which are affixed to each other to form a substantially enclosed chamber, the body section having at least one opening in the face portion thereof, the face portion having peripheral flanges around the opening therein extending into the interior of the body section, a text display member disposed within the opening with surfaces thereof adjacent to the perpheral flanges, means for securing the text display member to the peripheral flanges including a plurality of pins disposed through openings in the peripheral flanges and extending into the test display member, and the chamber of the body section being substantially filled with concrete.

10 Claims, 3 Drawing Figures

CEMETERY MONUMENT

This invention relates to a new cemetery marker and more particularly relates to a cemetery monument having a novel appearance.

Markers have been used throughout the ages for the marking of graves. Originally, these markers were simple wooden boards or arrangements of one or more rocks or stones. Through the years, the markers became more ornate and more formal as cemeteries developed for the burial of the dead. Most cemetery monuments have been formed of granite, marble or other types of stone. An identifying text usually is engraved on the face of the marker. Although the styles of cemetery monuments have changed, they still have utilized the same structural materials, namely, a type of stone. The only significant departure from this has been the use of bronze tablets in cemeteries that require ground level tablets for ease of maintenance.

Heretofore, it was believed that stone monuments met all needs because of their durability and their aesthetically pleasing appearance. Unfortunately, several trends have developed which reveal certain shortcomings of stone monuments. The cost of marble and granite has increased tremendously in recent years due to the limited supply of such natural products and the high cost of obtaining them. In addition, the large increases in shipping costs have greatly increased the cost of monuments at locations remote from the quarries. Also, cemetery vandalism is becoming much more prevalent and the repair of damage to granite and marble monuments often is impossible and where possible is very difficult and expensive.

The present invention provides a novel cemetery monument with improved durability. The cemetery monument of the invention is much less susceptible to vandalism damage. Also, if damage to the text does occur, that portion of the monument can be replaced simply and relatively inexpensively. In addition, the monument of the present invention may be fabricated from materials which are readily available commercially. Further, the monument can be fabricated utilizing techniques presently being employed in industry. Moreover, shipping costs of the basic monument unit are much less than those for stone monuments. In view of the above, the ultimate cost to the consumer of the monument of the invention is significantly less than that of monuments heretofore available.

Other benefits and advantages of the novel cemetery monument of the present invention will be apparent from the following description and the accompanying drawings in which.

Figure 1:
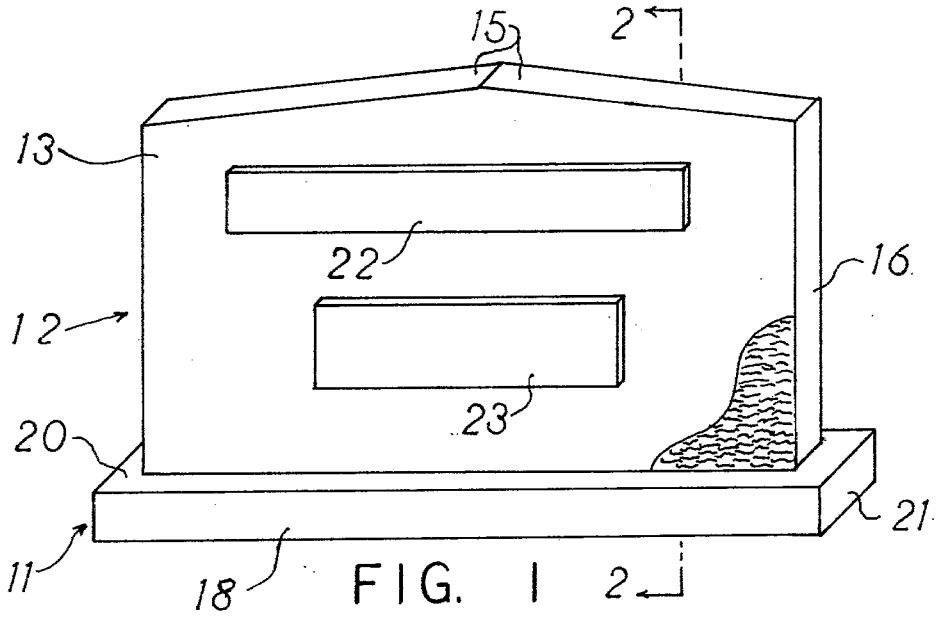
FIG. 1 is a view in perspective of one form of the novel cemetery monument of the invention.
Figure 2:
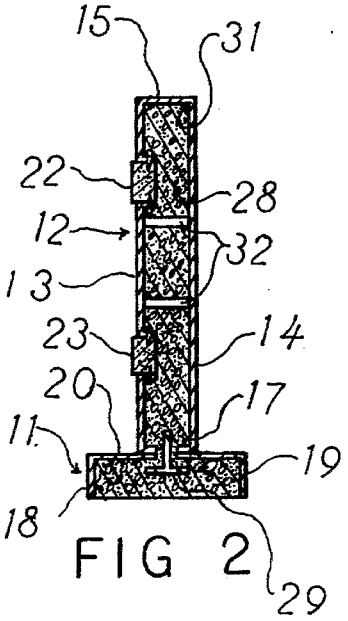
FIG. 2 is a sectional view taken along line 2—2 of FIG. 1.

As shown in the drawings, one form of the novel cemetery monument of the present invention includes a base 11 and a main body section 12 extending upwardly from the base. The base 11 and the body section 12 may be a single unit or as shown may be separate units combined to form an integral unit.

Body section 12 includes an outer shell formed of a plurality of textured corrosion-resistant metal panels. The body section 12 as shown includes a front or face panel 13, a back panel 14, top panels 15, end panels 16 and a bottom panel 17. The edges of the panels are affixed to each other, such as by welding, to form a substantially enclosed chamber. Base 11 advantageously is formed similarly to body section 12 with a front panel 18, a back panel 19, top panel 20 and end panels 21.

Figure 3:
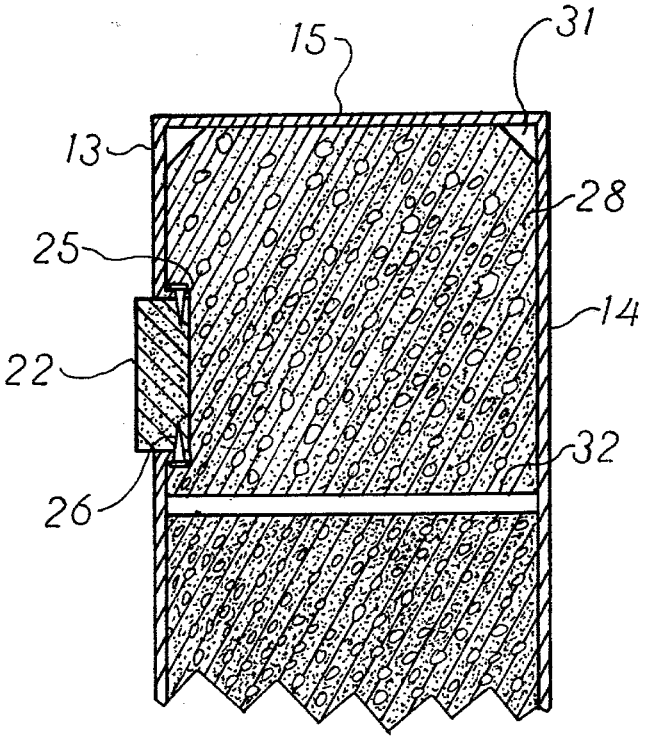
FIG. 3 is an enlarged fragmentary view of the sectional view of FIG. 2.

The face panel 13 of body section 12 has at least one opening. A text display member is disposed within each opening. The drawings show two openings with display members 22 and 23 disposed with the respective openings. Face panel 13 has peripheral flanges 25 around each opening in the panel. The peripheral flanges 25 extend into the interior of the body section 12 generally perpendicularly to the face panel 13 as shown in FIG. 3. Display members 22 and 23 advantageously are of a configuration which provides surfaces thereof adjacent to the peripheral flanges of face panel 13.

Means are provided for securing the text display members 22 and 23 to the peripheral flanges 25 of body section 12. As shown in the drawings, pins 26 extend through openings in peripheral flanges 25 into the display members 22 and 23 in a direction generally parallel to the face panel as shown in FIG. 3 to securely anchor the display members to the body section 12.

The monument of the invention is substantially filled with concrete to provide stability to the structure. Advantageously, the monument includes internal reinforcements. As shown in the drawings, heavier sections 31 may be located along the junctures of the metal panels. For example, heavier sections 31 may be located at the junctures of top panel 15 with front panel 13 and with back panel 14 as shown in FIG. 3. Also, cross members 32 may connect the major vertical panels 13 and 14 to maintain the spacing between these panels as the concrete is poured into the chamber within body section 12. In addition, reinforcing members 29 may be positioned adjacent the connection of body section 12 with base 11.

In the fabrication of the cemetery monument of the present invention as shown in the drawings, the panels 13–17 of the body section 12 and the panels 18–21 of the base 11 are cut from sheets of corrosion-resistant metal having a textured surface and preferably textured stainless steel. Face panel 13 of body section 12 has openings cut therein for the display members 22 and 23. These openings in panel 13 are cut so that portions may be bent back to form the flanges 25 which extend into the interior of body section 12. Openings are cut in the flanges 25 and corresponding openings are cut in display members 22 and 23. These openings will receive pins 26 to secure the display members to the body section.

The panels 13–17 are assembled to form body section 12 with the edges of the panels affixed to each other to form a substantially enclosed chamber. Advantageously, the panels are secured to each other by welding. The use of heliarc welding techniques for the welding of stainless steel is preferred. Heliarc welding incorporates electric welding with helium gas for cooling the hot weld. The base panels 18–21 can be combined and assembled in a similar manner.

The assembled body section and base either combined into a single unit or separate assemblies can be shipped conveniently to monument dealers. Since the body section and the base are hollow, the units are light in weight at this stage of their fabrication so freight on them is much less than that of conventional granite or marble monuments.

Upon receiving the body section and the base, the dealer combines them if this was not done at the factory. Before this, the dealer makes sure that the proper text display member has been installed in the body member or is available. This is important since the display member must be installed before the monument shell is filled with concrete.

The filling of the monument shell with concrete may be accomplished either in the dealer's shop or at the cemetery. It is important that the shell be properly braced against the pressure exerted by the concrete being poured into the shell. The bracing may be an internal reinforcement such as cross members 32 or may be external supports such as plywood or other sheeting positioned temporarily against the outer surface of the shell. If the base is to become an integral part of the monument, it may be desirable to incorporate a reinforcing member such as reinforcement 29 adjacent the connection of the body section 12 and the base 11. Such reinforcements may be spaced along the juncture or may be disposed continuously along it.

Upon setting up of the concrete inside the shell, the monument may be placed in its final resting place on the grave site. This can be accomplished in the conventional manner, preferably with an appropriate foundation. If desired, the depth of the concrete within or under the base can serve as the foundation. The text display member advantageously is engraved prior to its installation in the monument, although the engraving may be done after placement of the monument.

If it is necessary to replace the display members because of damage or other reasons, a tool may be inserted alongside the display member next to the flange and the pin 26 cut or broken so that the display member may be withdrawn and a new one inserted. Since the flanges are recessed in the concrete within the body section, new pins cannot be inserted as was done in the original fabrication. Thus, the display member must be secured to the body in a different way such as with an adhesive. While this installation is less desirable than the original pin arrangement, the replacement will only be necessary very infrequently.

The above description and the accompanying drawings show that the present invention provides a novel cemetery monument. The cemetery monument of the invention has improved durability and is much less susceptible to damage from vandalism than conventional monuments. Furthermore, if damage to the text portion should occur, the text portion of the monument can be replaced conveniently without the necessity for replacing the whole monument. Thus, replacement is relatively inexpensive.

Also, the monument of the invention may be fabricated from materials which are commercially available utilizing techniques presently employed in industry. In addition, the basic monument structure is much lighter in weight than conventional monuments so shipping costs are greatly reduced.

It will be apparent that various modifications can be made in the particular monument described above and shown in the drawings within the scope of the invention. Therefore, the scope of the invention is to be limited only by the following claims.

What is claimed is:

1. A cemetery monument including a base and a main body section extending upwardly from said base; said body section including an outer shell formed of a plurality of textured corrosion-resistant metal panels, the edges of which are affixed to each other forming a substantially enclosed chamber, said body section having at least one opening in the face portion thereof, said face portion having peripheral flanges around the opening therein extending into the interior of said body section generally perpendicular to said face portion, a text display member disposed within said opening with surfaces thereof adjacent to said peripheral flanges, means securing said text display member to said peripheral flanges including a plurality of pins disposed through openings in said peripheral flanges and extending into said text display member in a direction generally parallel to said face panel, and said chamber of said body section being substantially filled with concrete.

2. A cemetery monument according to claim 1 wherein said textured metal panels forming said body section have their edges connected by welding them together.

3. A cemetery monument according to claim 1 wherein said textured metal panels are stainless steel.

4. A cemetery monument according to claim 1 wherein said text display member is granite or marble.

5. A cemetery monument according to claim 1 wherein said test display member is bronze.

6. A cemetery monument according to claim 1 wherein said base is fabricated of textured metal panels similar to those of said body section.

7. A cemetery monument according to claim 1 wherein said body section has major vertical panels.

8. A cemetery monument according to claim 7 wherein said body section includes internal reinforcements including cross members connecting said major vertical panels.

9. A cemetery monument according to claim 1 wherein said body section includes internal reinforcements.

10. A cemetery monument according to claim 9 wherein said internal reinforcements include heavier edge sections along the junctures of said metal panels.

* * * * *